US007579046B2

(12) United States Patent
Lehman, Jr. et al.

(10) Patent No.: US 7,579,046 B2
(45) Date of Patent: Aug. 25, 2009

(54) SMART CURING WITH A CATALYST-FUNCTIONALIZED SURFACE

(75) Inventors: Stephen E. Lehman, Jr., Chandler, AZ (US); Vijay S. Wakharkar, Paradise Valley, AZ (US)

(73) Assignee: Intel Corporation, Santa Clara, CA (US)

( * ) Notice: Subject to any disclaimer, the term of this patent is extended or adjusted under 35 U.S.C. 154(b) by 385 days.

(21) Appl. No.: 11/322,402

(22) Filed: Dec. 30, 2005

(65) Prior Publication Data

US 2007/0154627 A1 Jul. 5, 2007

(51) Int. Cl.
*B05D 3/10* (2006.01)

(52) U.S. Cl. ..... 427/301; 427/99.1; 427/302; 428/413; 428/423.1; 428/500; 428/521; 428/522

(58) Field of Classification Search ..... None
See application file for complete search history.

(56) References Cited

U.S. PATENT DOCUMENTS 7,025,851 B2 * 4/2006 Caster et al. ..... 156/306.9
2003/0132121 A1 * 7/2003 Breen et al. ..... 205/231

FOREIGN PATENT DOCUMENTS

JP 2004-031392 * 1/2004

OTHER PUBLICATIONS

U.S. Appl. No. 11/241,258, filed Sep. 30, 2005; Inventor: Stephen E. Lehman Jr.

* cited by examiner

*Primary Examiner*—Marc S Zimmer
(74) *Attorney, Agent, or Firm*—Kathy J. Ortiz

(57) ABSTRACT

Smart curing by coupling a catalyst to one or more surface(s) of one or more microelectronic element(s) is generally described. In this regard, according to one example embodiment, a catalyst is coupled to one or more surface(s) of one or more microelectronic element(s) to promote polymerization of an adhesive brought in contact with the catalyst.

18 Claims, 8 Drawing Sheets

SMART CURING WITH A CATALYST-FUNCTIONALIZED SURFACE

TECHNICAL FIELD

Embodiments of the present invention are generally directed to microelectronic packaging and, more particularly, to underfill curing schemes for microelectronic packaging.

BACKGROUND

Underfill adhesives may be used in microelectronic assembly to fill the space between microelectronic components. The underfill adhesive may protect electrical connections such as bumps from moisture or other environmental hazards and provide additional mechanical strength to the assembly to prevent breaking or damaging electrical connections.

Typically, underfill adhesive formulations contain ingredients such as hardeners and catalysts, are stored at very cold temperatures to prevent curing, have short on-tool potlife, and require thermal energy to create a rigid or solid form adhesive. High temperatures for curing may be provided by oven cure, for example.

Curable adhesive chemistries that do not require an oven cure process may not be currently applied to microelectronics assembly. The potlife of such adhesives may be too short for manufacturability. Also, such adhesives may require very low storage and shipping temperatures to prevent the material from curing. Solutions are needed to improve manufacturability of package assembly adhesives. Improvements that minimize adhesive cure time at room temperature, increase the potlife on the tool, and make room temperature storage possible may improve manufacturability.

BRIEF DESCRIPTION OF THE DRAWINGS

Embodiments of the present invention are illustrated by way of example, and not by way of limitation, in the figures of the accompanying drawings in which like reference numerals refer to similar elements and in which.

DETAILED DESCRIPTION

Embodiments of smart curing with a catalyst-functionalized surface are described herein. In the following description, numerous specific details are set forth to provide a thorough understanding of embodiments of the invention. One skilled in the relevant art will recognize, however, that embodiments of the invention can be practiced without one or more of the specific details, or with other methods, components, materials, etc. In other instances, well-known structures, materials, or operations are not shown or described in detail to avoid obscuring aspects of various embodiments of the invention.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner in one or more embodiments.

Figure 1:
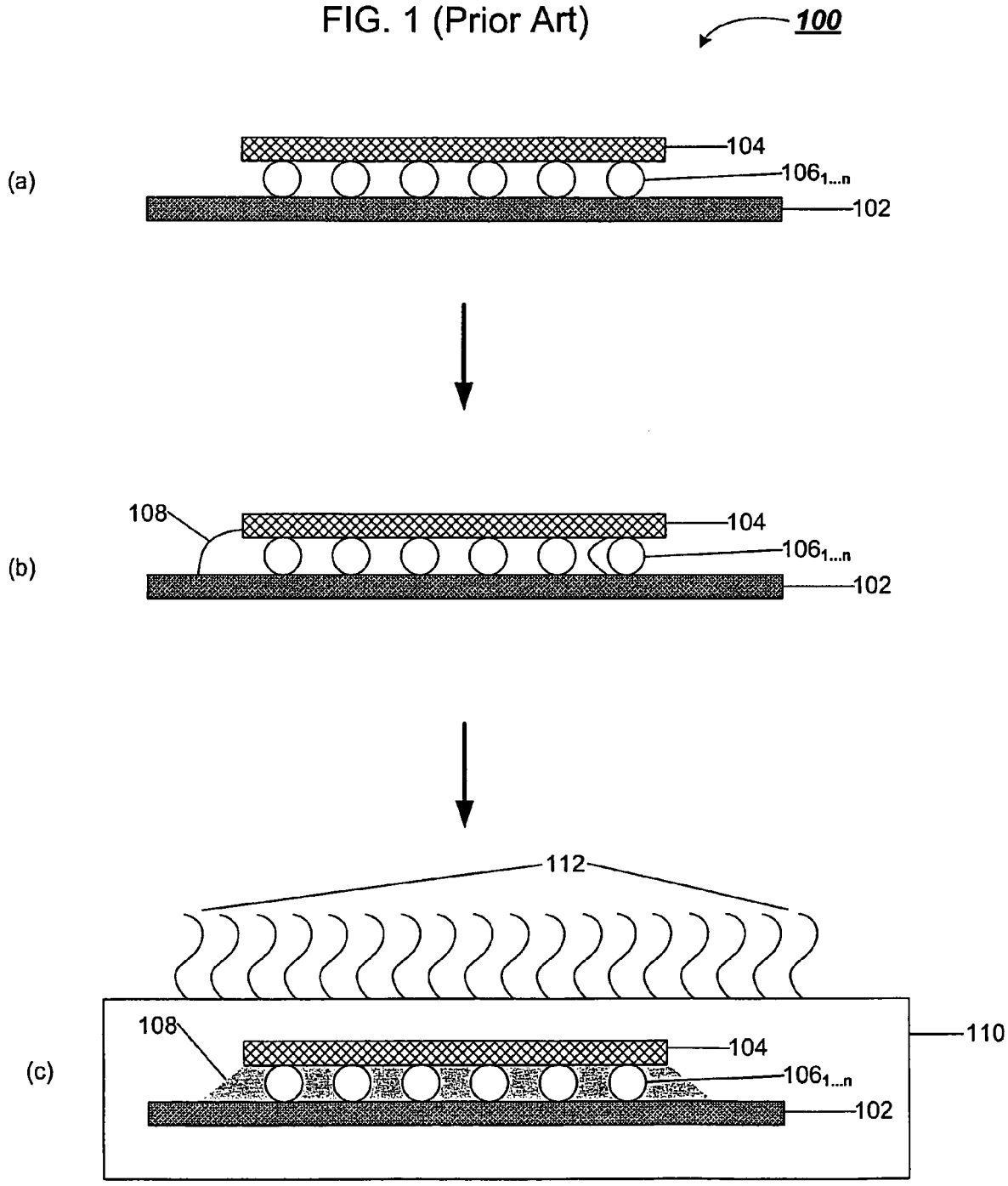
FIG. 1 (Prior Art)
FIG. 1 depicts a typical underfill process (prior art), according to but one example.

FIG. 1 depicts a typical underfill process 100, according to but one example embodiment. As depicted in FIG. 1(*a*), underfill process 100 may comprise one or more microelectronic element(s) such as substrate 102 and die 104 coupled together by an array of solder balls $\mathbf{106}_{1 \ldots n}$ (where n represents a variable number of repeating structures). Array of solder balls $\mathbf{106}_{1 \ldots n}$ may provide one or more electrical power and/or signal connections between substrate 102 and die 104.

FIG. 1(*b*) depicts application of underfill adhesive 108 between substrate 102 and die 104. Adhesive 108 may flow between substrate 102 and die 104 by capillary action. Adhesive 108 may contain ingredients such as hardeners and catalysts. As a result, adhesive 108 may need to be stored at very cold temperatures to prevent curing and may have short on-tool potlife (the useful time of a cartridge of underfill in the process tool between syringe changes).

FIG. 1(*c*) depicts an elevated temperature cure of adhesive 108 using a heat-producing apparatus 110 such as an oven. Heat waves 112 represent the elevated temperature of the heat-producing apparatus 110. Adhesive 108 may require thermal energy to create a rigid or solid form adhesive. High temperatures 112 for curing may be provided by oven cure, for example.

Figure 2:
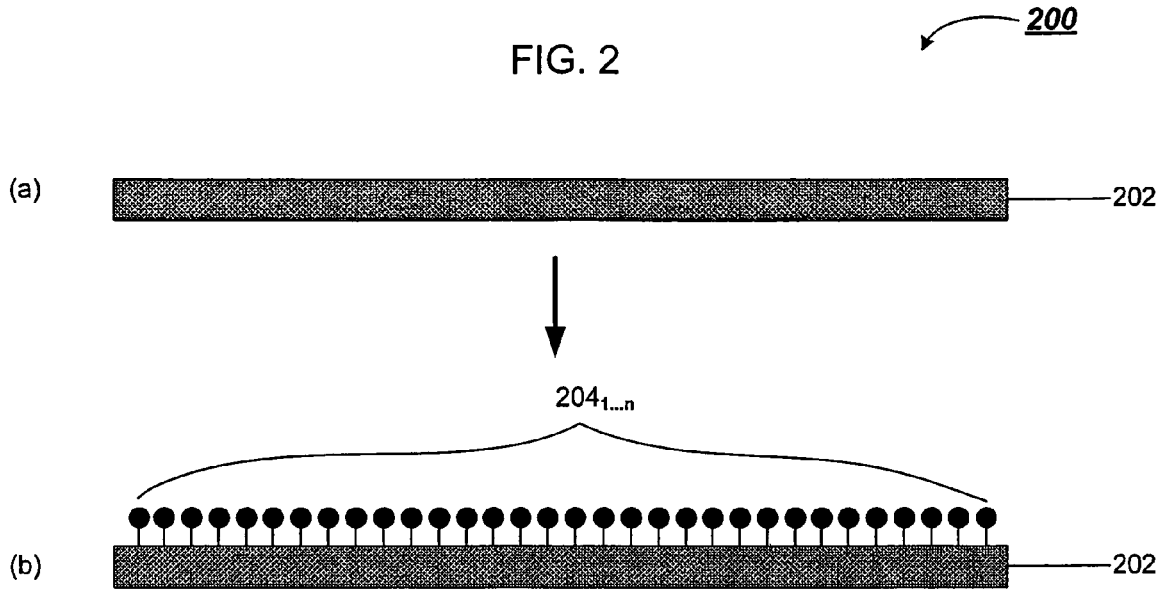
FIG. 2 depicts a chemisorption coupling method, according to but one example embodiment.

FIG. 2 depicts a chemisorption coupling method 200, according to but one example embodiment. FIG. 2(*a*) depicts one or more microelectronic element(s) 202 with one or more surface(s). One or more microelectronic element(s) 202 may include a variety of components and devices such as an integrated circuit die, a substrate, ball-grid array (BGA) package, printed circuit board, wafer, C4 (controlled collapse chip connect) array, and any suitable combination of such elements. One or more microelectronic element(s) 202 may include any other element that may benefit from a catalyst-functionalized surface as part of an underfill curing process.

FIG. 2(*b*) depicts a catalyst $\mathbf{204}_{1 \ldots n}$ comprising one or more catalyst molecules (where n represents a variable number of repeating structures) coupled to one or more surface(s) of one or more microelectronic element(s) 202. Catalyst $\mathbf{204}_{1 \ldots n}$ may be coupled to one or more microelectronic element(s) 202 by chemisorption, which is the chemical functionalization of a surface. Coupling by chemisorption may be accomplished by chemically bonding a catalyst $\mathbf{204}_{1 \ldots n}$ to solder resist surfaces with exposed silica and organic groups.

Solder resist surfaces may be primed with various compounds to promote bonding. Coupling by chemisorption may be accomplished by chemically bonding a catalyst $\mathbf{204}_{1 \ldots n}$ to passivation materials (on a die surface, for example) such as polyimides, phenolic resins, and silicon nitride, for example.

Catalyst $\mathbf{204}_{1 \ldots n}$ materials suitable for chemisorption may have properties including chemical reactivity with the one or more surface(s) of the one or more microelectronic element(s) 202, amorphous film forming qualities, and very high reactivity with an adhesive such as epoxy resins, for example. In one embodiment, catalyst molecules $\mathbf{204}_{1 \ldots n}$ may comprise two functional groups, the first to react and bind with the surface, the second to catalyze the cure or polymerization of an adhesive. The first functional group may comprise one of the following example functionalities: trialkoxysilane, chlorosilanes, acid chlorides, amines, azides, alkynes, and amines. The second group may comprise one of the following example functionalities: substituted imidazoles, N-heterocyclic carbenes, carboxylic acids, amines, and highly Lewis acidic compounds including trifluoroborate adducts.

Application of catalyst $\mathbf{204}_{1 \ldots n}$ to one or more surface(s) of one or more microelectronic element(s) 202 may be accomplished by one or more of several techniques. In one embodiment, a solution comprising catalyst $\mathbf{204}_{1 \ldots n}$ may be applied to a surface by dip coating, screen printing, or spraying. A solution of the catalyst $\mathbf{204}_{1 \ldots n}$ may be spin-coated onto a wafer surface. A heat treatment may be used to evaporate solvent or achieve chemical bonding to the surface(s) of one or more microelectronic element(s) 202.

Figure 3:
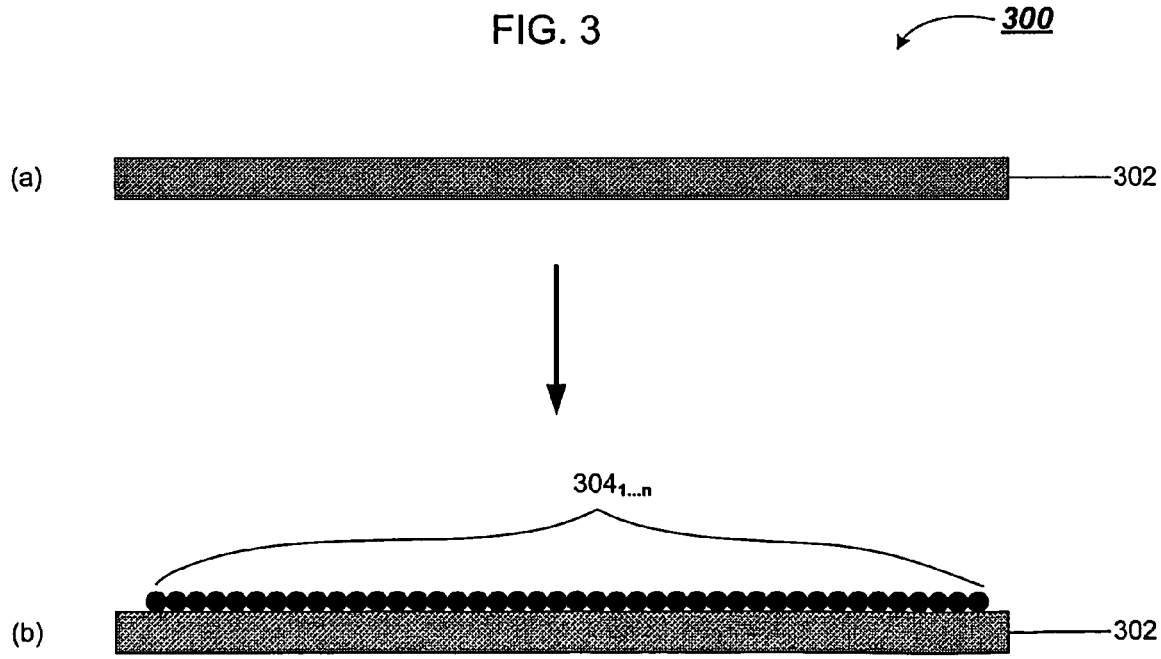
FIG. 3 depicts a physisorption coupling method, according to but one example embodiment.

FIG. 3 depicts a physisorption coupling method 300, according to but one example embodiment. FIG. 3(*a*) depicts one or more microelectronic element(s) 302 with at least a surface. One or more microelectronic element(s) 302 may include a variety of components and devices such as an integrated circuit die, a substrate, BGA package, printed circuit board, wafer, C4 array, and any suitable combination of such elements. One or more microelectronic element(s) 302 may include any other element that may benefit from a catalyst-functionalized surface as part of an underfill curing process.

FIG. 3(*b*) depicts a catalyst $\mathbf{304}_{1 \ldots n}$ comprising one or more catalyst molecules (where n represents a variable number of repeating structures) coupled to one or more surface(s) of one or more microelectronic element(s) 302. Catalyst $\mathbf{304}_{1 \ldots n}$ may be coupled to one or more microelectronic element(s) 302 by physisorption, which is the physical functionalization of a surface. In one embodiment, physical functionalization may comprise coating a surface with a solution including catalyst $\mathbf{304}_{1 \ldots n}$ Catalyst $\mathbf{304}_{1 \ldots n}$ may not be chemically bonded to the surface of one or more microelectronic element(s).

Catalyst $\mathbf{304}_{1 \ldots n}$ materials suitable for physisorption may have properties including amorphous film forming qualities and very high reactivity with an underfill adhesive such as epoxy resins, for example. In one embodiment, catalyst $\mathbf{304}_{1 \ldots n}$ may comprise one of the following functional groups: substituted imidazoles, N-heterocyclic carbene adducts, carboxylic acids, amines, and highly Lewis acidic compounds including trifluoroborate adducts.

Application of catalyst $\mathbf{304}_{1 \ldots n}$ to one or more surface(s) of one or more microelectronic element(s) 302 may be accomplished by one or more of several means. In one embodiment, a solution comprising catalyst $\mathbf{304}_{1 \ldots n}$ may be applied to a surface by dip coating, screen printing, or spraying. A solution of the catalyst $\mathbf{304}_{1 \ldots n}$ may be spin-coated onto a wafer surface. A heat treatment may be used to evaporate solvent.

Figure 4:
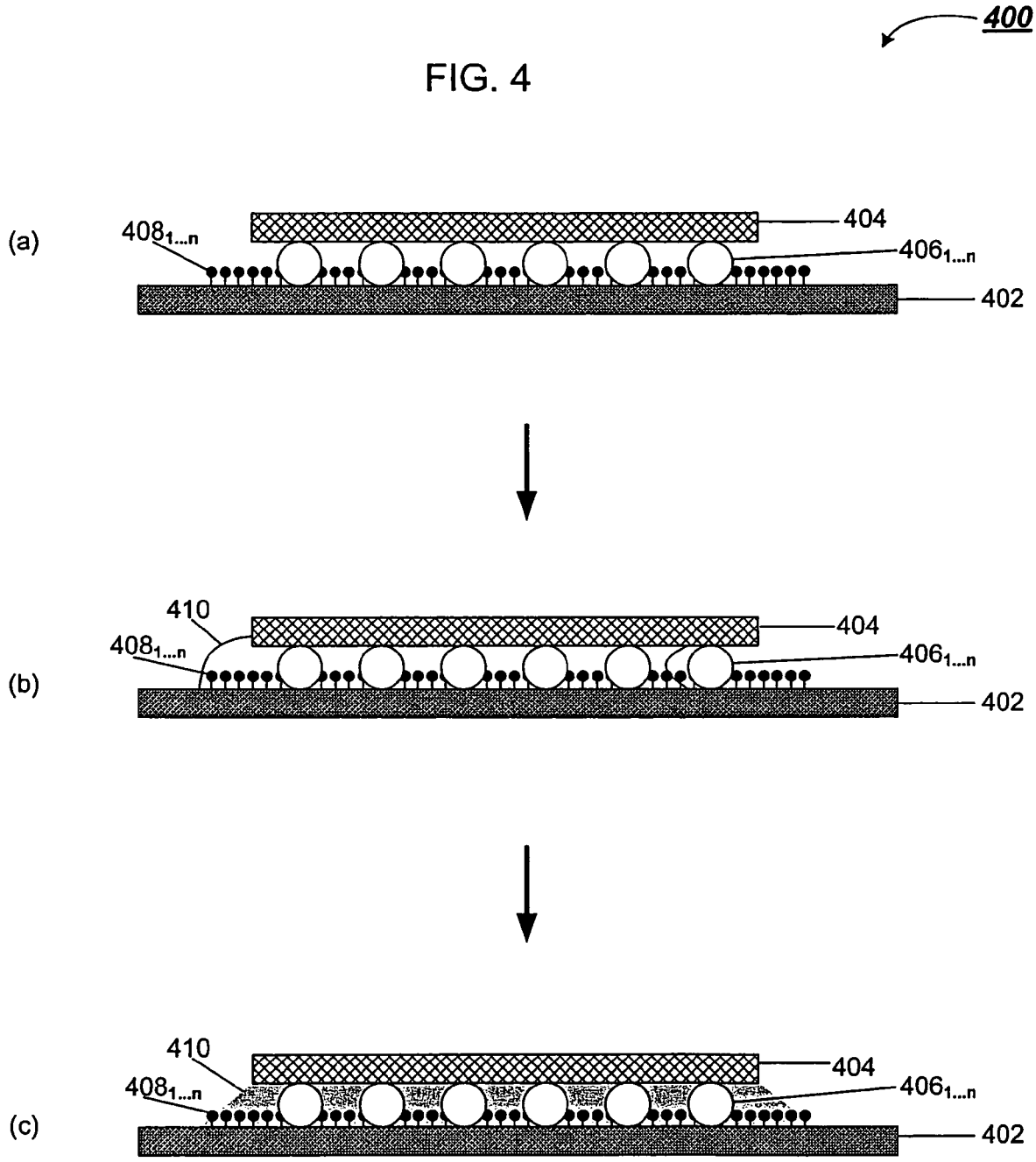
FIG. 4 depicts an underfill process involving a die and substrate using a catalyst-functionalized surface, according to but one example embodiment.

FIG. 4 depicts an underfill process 400 using a catalyst-functionalized surface, according to but one example embodiment. FIG. 4(*a*) features a substrate 402, die 404, array of solder balls $\mathbf{406}_{1 \ldots n}$, and catalyst $\mathbf{408}_{1 \ldots n}$ (where n represents a variable number of repeating structures), each coupled as shown.

Catalyst $\mathbf{408}_{1 \ldots n}$ may be coupled to substrate 402 by chemisorption or physisorption, though depicted as coupled by chemisorption in the illustrated embodiment. Moreover, catalyst $\mathbf{408}_{1 \ldots n}$ may be coupled to one or more surface(s) of one or more microelectronic element(s) 402, 404 including others not depicted in the illustrated embodiment such as a BGA package and circuit board, for example.

FIG. 4(*b*) depicts application of underfill adhesive 410 between substrate 402 and die 404. Adhesive 410 may flow between substrate 402 and die 404 by capillary action or any other suitable adhesive application method. Adhesive 410 may substantially fill the space between one or more microelectronic element(s) such as substrate 402 and die 404. In one embodiment, adhesive 410 is coupled to the one or more surface(s) of the one or more microelectronic element(s) 402, 404.

In an embodiment, adhesive 410 comprises epoxies. In alternative embodiments, adhesive 410 comprises alternative chemistries such as acrylates, vinyl ethers, olefin metathesis, urethanes, and others.

In one embodiment, adhesive 410 expressly does not include a hardener ingredient and does not include a catalyst ingredient. Formulations of adhesive 410 may not contain any hardener or catalyst ingredient at all. For example, adhesive formulations may comprise epoxy resins, filler, wetting agents, toughening agents, coupling agents and other components known to those skilled in the art, with no catalyst or hardener at all. Such formulation without catalysts or hardeners in the adhesive itself may provide several benefits including much longer potlife and ability to store at or near room temperature.

In an embodiment, adhesive 410 makes contact with catalyst $\mathbf{408}_{1 \ldots n}$ on the surface of a microelectronic element, which initiates or catalyzes polymerization or curing of adhesive 410. Catalyst $\mathbf{408}_{1 \ldots n}$ may promote polymerization of an adhesive 410 upon reactive contact.

FIG. 4(*c*) depicts the cure of adhesive 410. Adhesive 410 may begin to polymerize or cure upon contact with a catalyst-functionalized surface $\mathbf{408}_{1 \ldots n}$. The cure of adhesive 410 may be rapid and may occur at low temperature. In one embodiment, adhesive 410 curing occurs at or near room temperature. Adhesive 410 may not require the addition of thermal energy to create a rigid or solid form adhesive.

The use of catalyst-functionalized surfaces $\mathbf{408}_{1 \ldots n}$ in a package assembly curing scheme 400 may provide the benefit of allowing room temperature storage, increasing potlife, and allowing rapid cure at low temperature of an underfill adhesive 410. Adhesive 410 may not contain catalyst or hardener ingredients and, thus, may not begin to polymerize or cure until the formulation is brought into contact with the catalyst-functionalized surface $\mathbf{408}_{1 \ldots n}$. Adhesive 410 may have very low reactivity at ambient temperature allowing for long potlife and room temperature storage, but may have high reactivity once brought into contact with catalyst-functionalized surfaces $\mathbf{408}_{1 \ldots n}$ allowing rapid cure and/or cure at low temperature.

Figure 5:
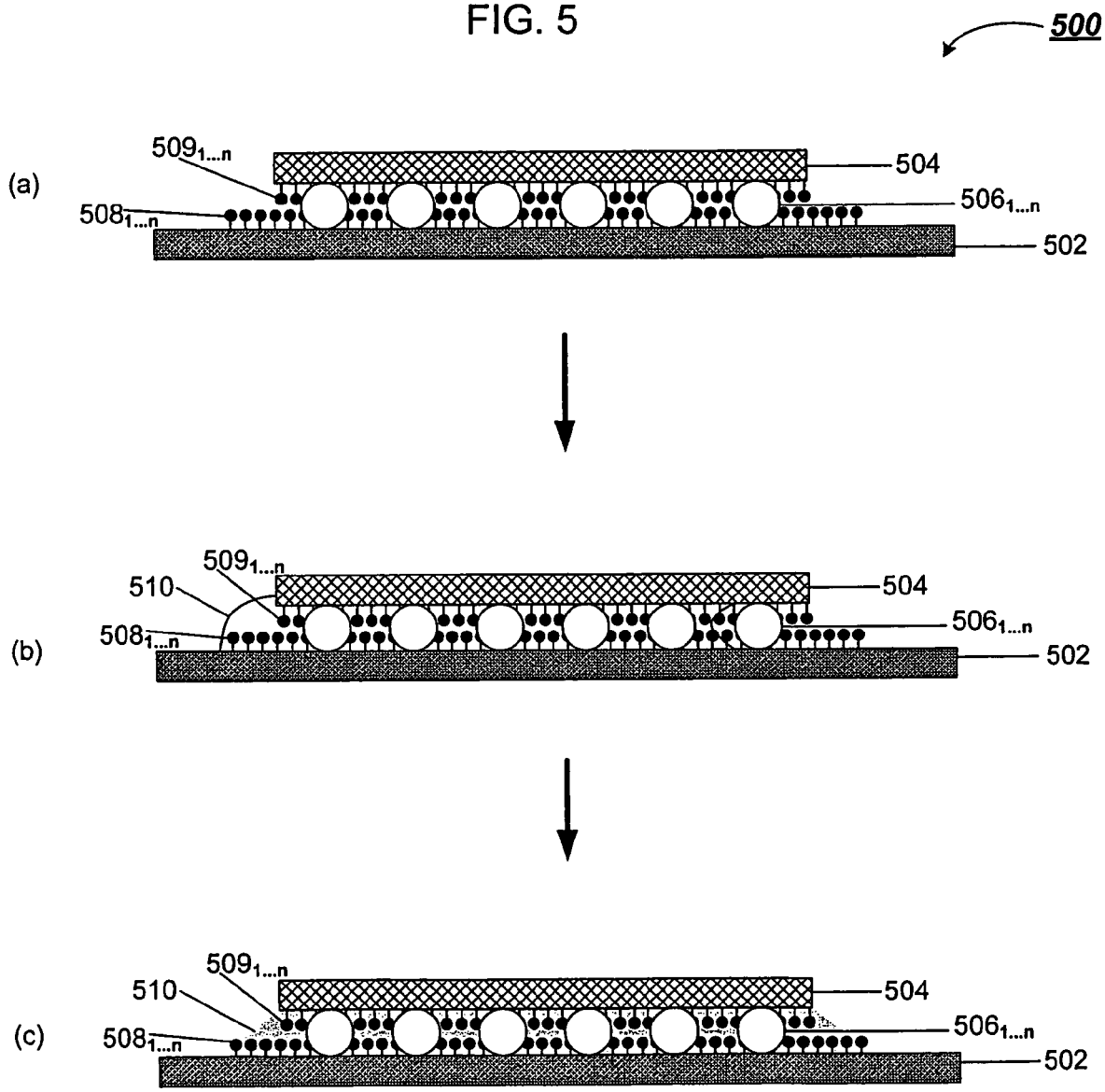
FIG. 5 depicts an underfill process involving a die and substrate using catalyst-functionalized surfaces, according to but one example embodiment.

FIG. 5 depicts an underfill process 500 using catalyst-functionalized surfaces, according to but one example embodiment. FIG. 5(*a*) features a substrate 502, die 504, array of solder balls $\mathbf{506}_{1 \ldots n}$, catalyst $\mathbf{508}_{1 \ldots n}$ coupled to substrate 502, and catalyst $\mathbf{509}_{1 \ldots n}$ coupled to die 504 (where n represents a variable number of repeating structures), each coupled as shown.

Catalyst $\mathbf{508}_{1 \ldots n}$ may be coupled to substrate 502 by chemisorption or physisorption and catalyst $\mathbf{509}_{1 \ldots n}$ may be coupled to die 504 by chemisorption or physisorption, though both are depicted as coupled by chemisorption in the illustrated embodiment.

FIG. 5(*b*) depicts application of underfill adhesive 510 between substrate 502 and die 504. Adhesive 510 may flow between substrate 502 and die 504 by capillary action or any other suitable adhesive application method. Adhesive 510 may substantially fill the space between one or more microelectronic element(s) such as substrate 502 and die 504. In one embodiment, adhesive 510 is coupled to the one or more surface(s) of the one or more microelectronic element(s) 502, 504.

In an embodiment, adhesive 510 comprises epoxies. In alternative embodiments, adhesive 510 comprises alternative chemistries such as acrylates, vinyl ethers, olefin metathesis, urethanes, and others.

In one embodiment, adhesive 510 expressly does not comprise a hardener ingredient and does not comprise a catalyst ingredient. Formulations of adhesive 510 may not contain any hardener or catalyst ingredient at all. For example, adhesive formulations may comprise epoxy resins, filler, wetting agents, toughening agents, coupling agents and other components known to those skilled in the art, with no catalyst or hardener at all. Such formulation without catalysts or hardeners in the adhesive itself may provide several benefits including much longer potlife and ability to store the adhesive at or near room temperature.

In an embodiment, adhesive 510 makes contact with catalysts $\mathbf{508}_{1 \ldots n}$ and $\mathbf{509}_{1 \ldots n}$ on the surfaces of substrate 502 and die 504, which initiates or catalyzes polymerization or curing of adhesive 510. Catalysts $\mathbf{508}_{1 \ldots n}$ and $\mathbf{509}_{1 \ldots n}$ may promote polymerization of an adhesive 510 upon reactive contact of adhesive 510 with catalysts $\mathbf{508}_{1 \ldots n}$ and $\mathbf{509}_{1 \ldots n}$.

FIG. 5(*c*) depicts the cure of adhesive 510. Adhesive 510 may begin to polymerize or cure upon contact with catalyst-functionalized surfaces $\mathbf{508}_{1 \ldots n}$ and $\mathbf{509}_{1 \ldots n}$. The cure or polymerization of adhesive 510 may be rapid and may occur at low temperature. In one embodiment, adhesive 510 curing occurs at or near room or ambient temperature. Adhesive 510 may not require the addition of thermal energy to create a rigid or solid form adhesive.

The use of catalyst-functionalized surfaces $\mathbf{508}_{1 \ldots n}$ and $\mathbf{509}_{1 \ldots n}$ in a package assembly curing scheme 500 may provide the benefit of allowing room temperature storage, increasing potlife, and allowing rapid cure at low temperature of an underfill adhesive 510. Adhesive 510 may not contain catalyst or hardener ingredients and, thus, may not begin to polymerize or cure until the formulation is brought into contact with the catalyst-functionalized surfaces $\mathbf{508}_{1 \ldots n}$ and $\mathbf{509}_{1 \ldots n}$. Adhesive 510 may have very low reactivity at ambient temperature allowing for long potlife and room temperature storage, but may have high reactivity once brought into contact with catalyst-functionalized surfaces $\mathbf{508}_{1 \ldots n}$ and $\mathbf{509}_{1 \ldots n}$ allowing rapid cure and/or cure at low temperature.

Figure 6:
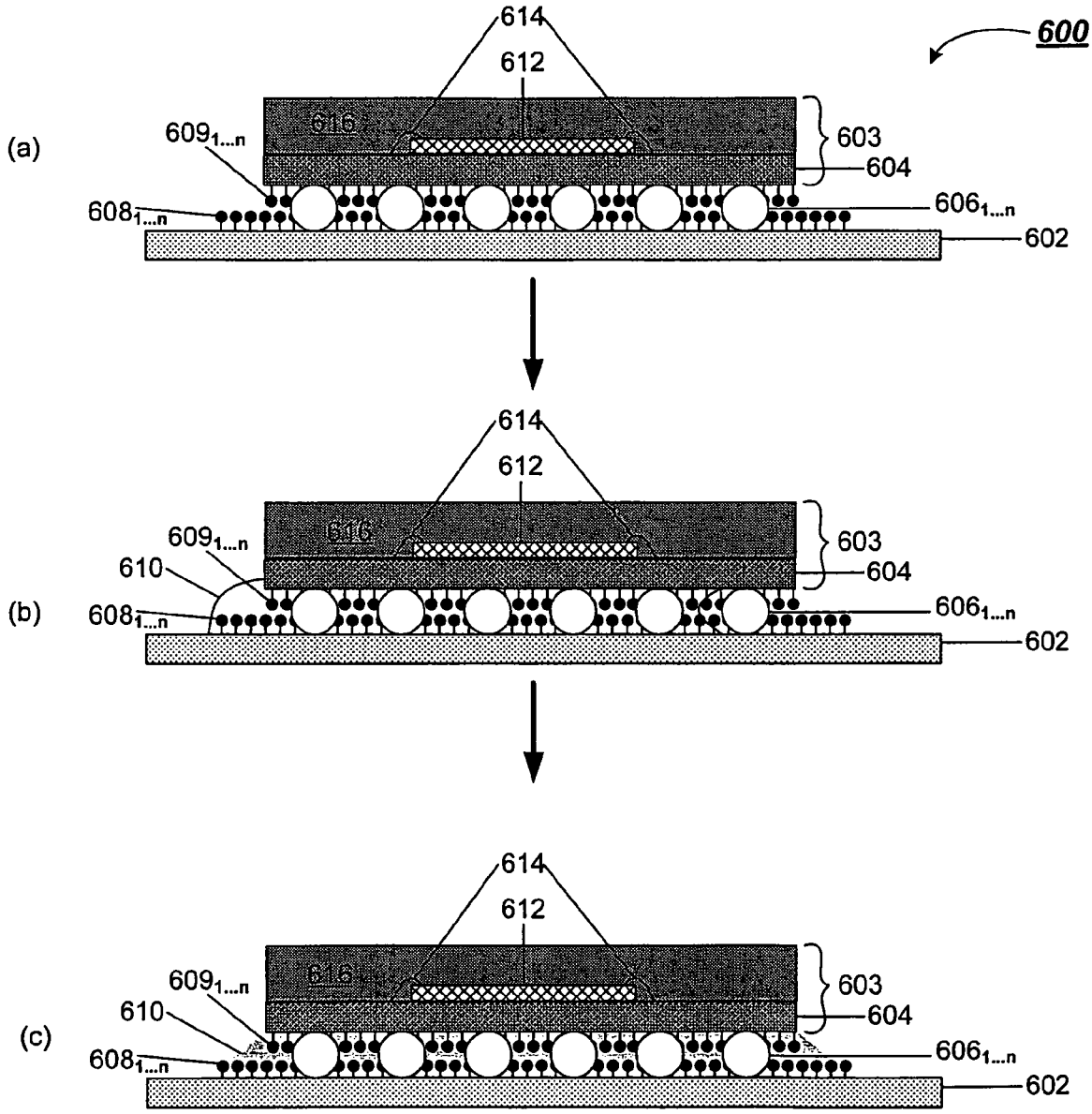
FIG. 6 depicts an underfill process involving a ball-grid array (BGA) package and circuit board using catalyst-functionalized surfaces, according to but one example embodiment.

FIG. 6 depicts an underfill process 600 using catalyst-functionalized surfaces, according to but one example embodiment. FIG. 6(*a*) features a circuit board 602, BGA package 603 (BGA package 603 comprising substrate 604, die 612, wire bonds 614, and mold compound 616), array of solder balls $\mathbf{606}_{1 \ldots n}$, catalyst $\mathbf{608}_{1 \ldots n}$ coupled to circuit board 602, and catalyst $\mathbf{609}_{1 \ldots n}$ coupled to BGA package 603 (where n represents a variable number of repeating structures), each coupled as shown.

Catalyst $\mathbf{608}_{1 \ldots n}$ may be coupled to circuit board 602 by chemisorption or physisorption and catalyst $\mathbf{609}_{1 \ldots n}$ may be coupled to BGA package 603 by chemisorption or physisorption, though both are depicted as coupled by chemisorption in the illustrated embodiment. Moreover, in other embodiments a catalyst may be coupled to only one of the microelectronic elements. For example, circuit board 602 may have a catalyst-functionalized surface $\mathbf{608}_{1 \ldots n}$ and BGA package 603 may not have a catalyst-functionalized surface.

FIG. 6(*b*) depicts application of underfill adhesive 610 between circuit board 602 and BGA package 603. Adhesive 610 may flow between circuit board 602 and BGA package 603 by capillary action or any other suitable adhesive application method. Adhesive 610 may substantially fill the space between one or more microelectronic element(s) such as circuit board 602 and BGA package 603. In one embodiment, adhesive 610 is coupled to the one or more surface(s) of the one or more microelectronic element(s) 602, 603.

In an embodiment, adhesive 610 comprises epoxies. In alternative embodiments, adhesive 610 comprises alternative chemistries such as acrylates, vinyl ethers, olefin metathesis, urethanes, and others.

In one embodiment, adhesive 610 expressly does not comprise a hardener ingredient and does not comprise a catalyst ingredient. Formulations of adhesive 610 may not contain any hardener or catalyst ingredient at all. For example, adhesive formulations may comprise epoxy resins, filler, wetting agents, toughening agents, coupling agents and other components known to those skilled in the art, with no catalyst or hardener at all. Such formulation without catalysts or hardeners in the adhesive itself may provide several benefits including much longer potlife and ability to store the adhesive at or near room temperature.

In an embodiment, adhesive 610 makes contact with catalysts $\mathbf{608}_{1 \ldots n}$ and $\mathbf{609}_{1 \ldots n}$ on the surfaces of circuit board 602 and BGA package 603, which initiates or catalyzes polymerization or curing of adhesive 610. Catalysts $\mathbf{608}_{1 \ldots n}$ and $\mathbf{609}_{1 \ldots n}$ may promote polymerization of an adhesive 610 upon reactive contact of adhesive 610 with catalysts $\mathbf{608}_{1 \ldots n}$ and $\mathbf{609}_{1 \ldots n}$.

FIG. 6(*c*) depicts the cure of adhesive 610. Adhesive 610 may begin to polymerize or cure upon contact with catalyst-functionalized surfaces $\mathbf{608}_{1 \ldots n}$ and $\mathbf{609}_{1 \ldots n}$. The cure of adhesive 610 may be rapid and may occur at low temperature. In one embodiment, adhesive 610 curing occurs at or near room or ambient temperature. Adhesive 610 may not require the addition of thermal energy to create a rigid or solid form adhesive.

The use of catalyst-functionalized surfaces $\mathbf{608}_{1 \ldots n}$, and $\mathbf{609}_{1 \ldots n}$, in a package assembly curing scheme 600 may provide the benefit of allowing room temperature storage, increasing potlife, and allowing rapid cure at low temperature of an underfill adhesive 610. Adhesive 610 may not contain catalyst or hardener ingredients and, thus, may not begin to polymerize or cure until the formulation is brought into contact with the catalyst-functionalized surfaces $\mathbf{608}_{1 \ldots n}$ and $\mathbf{609}_{1 \ldots n}$. Adhesive 610 may have very low reactivity at ambient temperature allowing for long potlife and room temperature storage, but may have high reactivity once brought into contact with catalyst-functionalized surfaces $\mathbf{608}_{1 \ldots n}$ and $\mathbf{609}_{1 \ldots n}$ allowing rapid cure and/or cure at low temperature.

Figure 7:
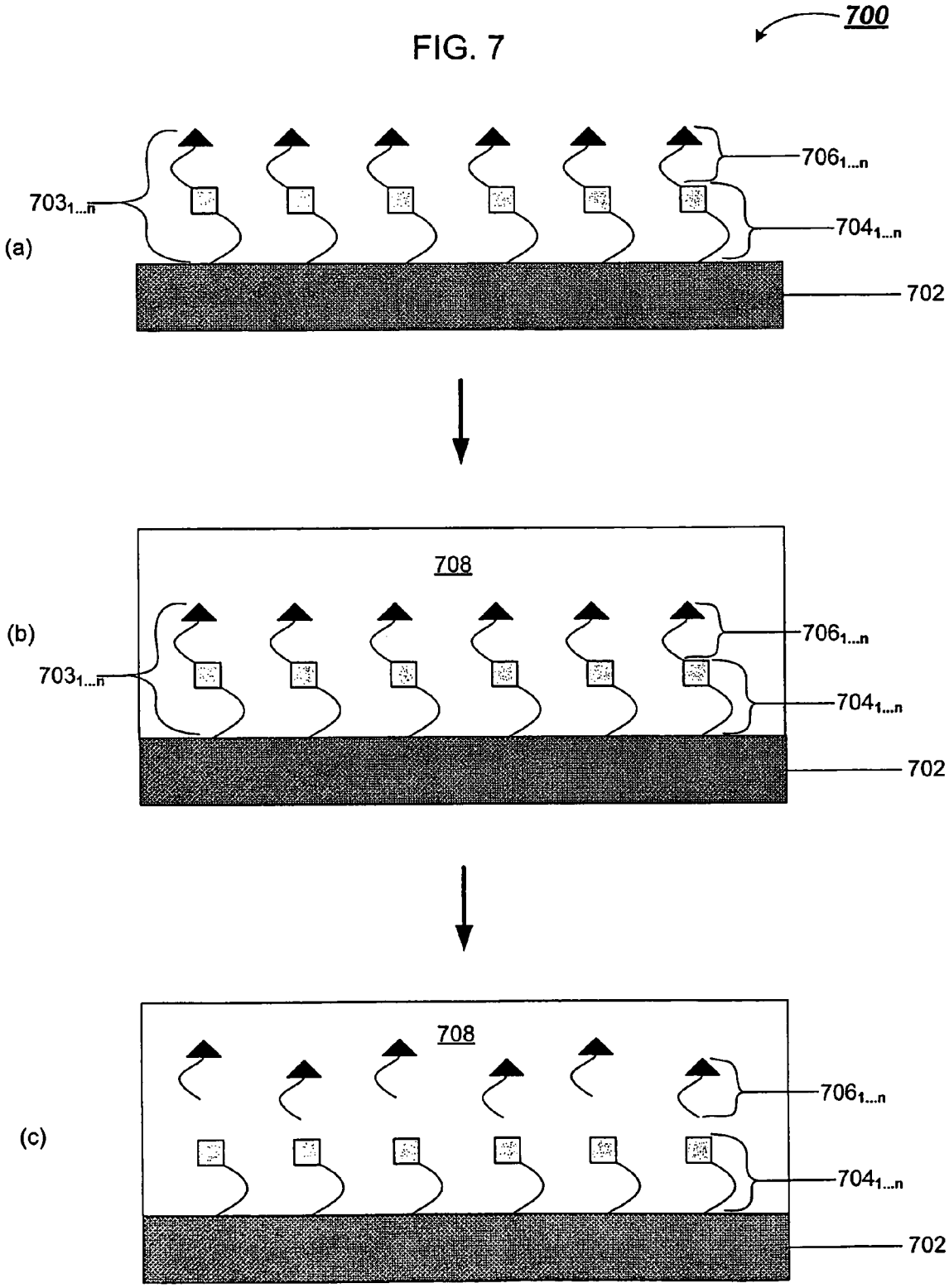
FIG. 7 is a schematic of a catalyst-functionalized surface in an underfill process, according to but one example embodiment.

FIG. 7 is a schematic of a catalyst-functionalized surface in an underfill process 700, according to but one example embodiment. FIG. 7(*a*) features one or more catalyst molecules $703_{1 \ldots n}$, comprising a first functional group $704_{1 \ldots n}$ to react and bind with the surface and a second functional group $706_{1 \ldots n}$ to catalyze the cure or polymerization of an adhesive, each coupled as shown. The catalyst molecules $703_{1 \ldots n}$ may be coupled to the surface of one or more microelectronic element(s) 702.

Catalyst molecules $703_{1 \ldots n}$ may be coupled to microelectronic element by chemisorption. One or more microelectronic element(s) 702 may include a variety of components and devices such as an integrated circuit die, a substrate, ball-grid array (BGA) package, printed circuit board, wafer, C4 (controlled collapse chip connect) array, and any suitable combination of such elements. One or more microelectronic element(s) 702 may include any other element that may benefit from a catalyst-functionalized surface as part of an underfill curing process.

FIG. 7(*b*) shows the addition of an adhesive 708 to the surface of one or more microelectronic element(s) 702. In an embodiment, adhesive 708 comprises epoxies. In alternative embodiments, adhesive 708 comprises alternative chemistries such as acrylates, vinyl ethers, olefin metathesis, urethanes, and others.

In one embodiment, adhesive 708 expressly does not comprise a hardener ingredient and does not comprise a catalyst ingredient. Formulations of adhesive 708 may not contain any hardener or catalyst ingredient at all. For example, adhesive formulations may comprise epoxy resins, filler, wetting agents, toughening agents, coupling agents and other components known to those skilled in the art, with no catalyst or hardener at all. Such formulation without catalysts or hardeners in the adhesive itself may provide several benefits including much longer potlife and ability to store the adhesive at or near room temperature.

In an embodiment, adhesive 708 makes contact with catalysts $703_{1 \ldots n}$ on the surface of microelectronic element 702, which initiates or catalyzes polymerization or curing of adhesive 708. More particularly, second functional group $706_{1 \ldots n}$ may promote polymerization of an adhesive 708 upon reactive contact of adhesive 708 with second functional group $706_{1 \ldots n}$.

FIG. 7(*c*) illustrates the separation of first functional group $704_{1 \ldots n}$ from second functional group $706_{1 \ldots n}$ upon contact with adhesive 708. In one embodiment, first functional group $704_{1 \ldots n}$ and second functional group $706_{1 \ldots n}$ are coupled together with a labile bond that may be cleaved upon contact with the underfill adhesive formulation 708. The second functional group $706_{1 \ldots n}$ may be covalently cleaved from the first functional group $704_{1 \ldots n}$ during the polymerization reaction such that the second functional group $706_{1 \ldots n}$ is dispersed through the adhesive 708 rather than being concentrated at the surface of the microelectronic element 702. Such separation may provide a more rapid and well-dispersed reaction. The second functional group $706_{1 \ldots n}$ may comprise, among other functionalities, esters, dithianes, N-heterocyclic carbene adducts, cyclobutanes, and other strained molecules.

Protic acid functionality may provide similar benefits as a labile bond. For example, carboxylic and sulfonic acids, and salts such as tertiary ammonium may dissociate upon application of an adhesive 708 by ionic dissociation. In one embodiment, catalyst molecule $706_{1 \ldots n}$ comprises a molecule with protic acid functionality.

Figure 8:
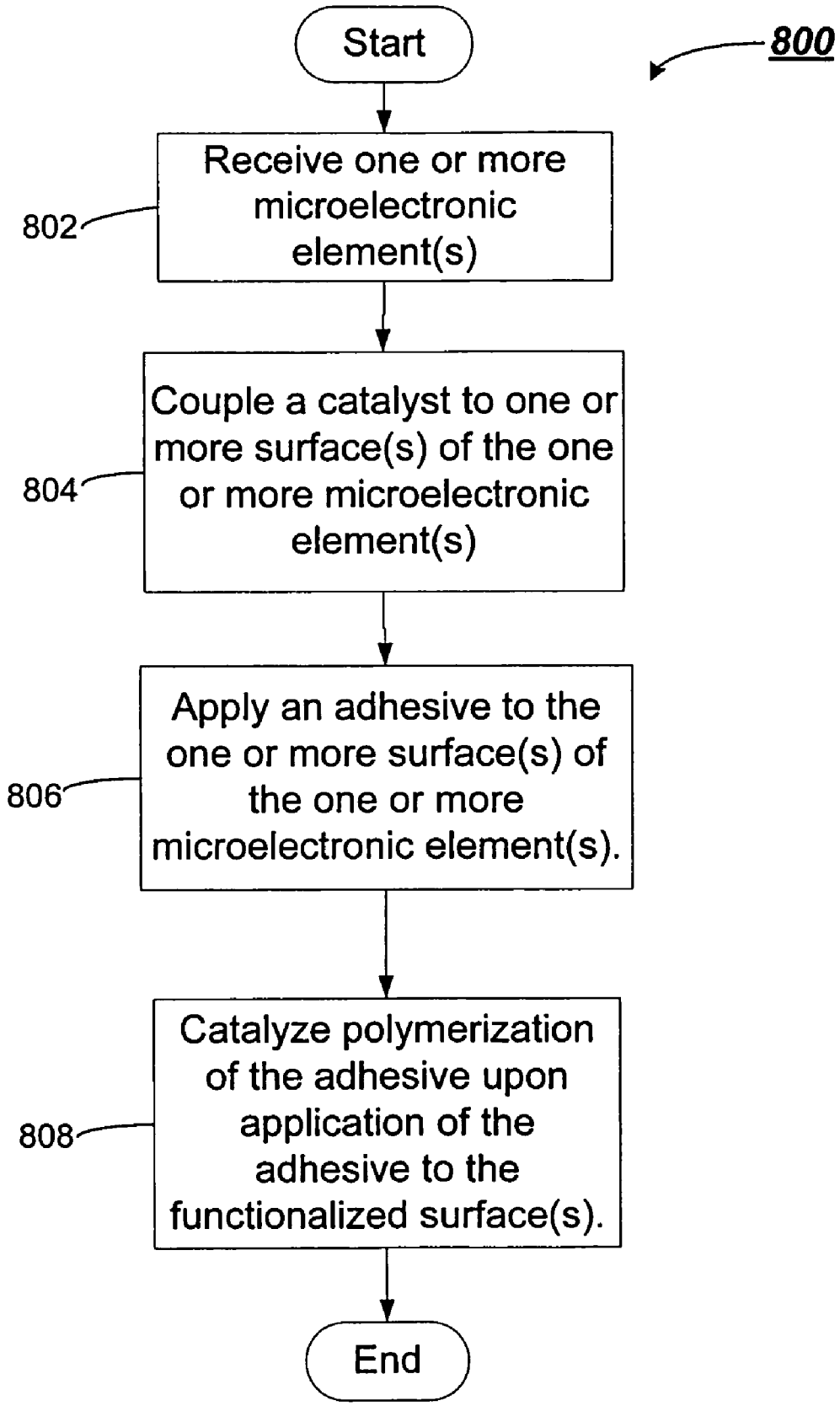
FIG. 8 is a flow chart of an example method to improve an underfill process, according to but one example embodiment.

FIG. 8 is a flow chart of an example method to improve an underfill process comprising receiving one or more microelectronic element(s) 802, coupling a catalyst to one or more surface(s) of one or more microelectronic element(s) 804, applying an adhesive to one or more surface(s) of the one or more microelectronic element(s) 806, and catalyzing polymerization of the adhesive upon application of the adhesive to the catalyst-functionalized surface(s), according to but one example embodiment.

Manufacturing equipment may receive one or more microelectronic element(s) 802 to couple a catalyst to one or more surface(s) of one or more microelectronic element(s) 804. A catalyst may be coupled to one or more surface(s) 804 to promote polymerization 808 of an adhesive that is applied to the one or more surface(s) 806.

Receiving one or more microelectronic element(s) 802 may comprise receiving a variety of components and devices such as an integrated circuit die, a substrate, ball-grid array (BGA) package, printed circuit board, wafer, C4 (controlled collapse chip connect) array, and any suitable combination of such elements. One or more microelectronic element(s) may include any other element that may benefit from a catalyst-functionalized surface as part of an underfill curing process.

A catalyst may be coupled to one or more surface(s) 804 by applying a catalyst to one or more surface(s) of one or more microelectronic element(s). Application of catalyst to one or more surface(s) of one or more microelectronic element(s) may be accomplished by one or more of several means. In one embodiment, a solution comprising catalyst may be applied to a surface by dip coating, screen printing, or spraying. A solution of the catalyst may be spin-coated onto a wafer surface. A heat treatment may be used to evaporate solvent or achieve chemical bonding to the surface(s) of one or more microelectronic element(s).

In one embodiment, a catalyst may be coupled to one or more surface(s) of one or more microelectronic element(s) by chemisorption, which is the chemical functionalization of a surface. Coupling by chemisorption may be accomplished by chemically bonding a catalyst to solder resist surfaces with exposed silica and organic groups. Solder resist surfaces may be primed with various compounds to promote bonding. Coupling by chemisorption may be accomplished by chemically bonding a catalyst to passivation materials (on a die surface, for example) such as polyimides, phenolic resins, and silicon nitride, for example.

Catalyst materials suitable for chemisorption may have properties including chemical reactivity with the one or more surface(s) of the one or more microelectronic element(s), amorphous film forming qualities, and very high reactivity with an adhesive such as epoxy resins, for example. In one embodiment, catalyst molecules may comprise two functional groups, the first to react and bind with the surface, the second to catalyze the cure or polymerization of an adhesive. The first functional group may comprise one of the following example functionalities: trialkoxysilane, chlorosilanes, acid chlorides, amines, azides, alkynes, and amines. The second group may comprise one of the following example functionalities: substituted imidazoles, N-heterocyclic carbenes, carboxylic acids, amines, and highly Lewis acidic compounds including trifluoroborate adducts.

In one embodiment, the first functional and second functional groups may be coupled together with a bond such that the bond breaks upon reaction of the catalyst with an adhesive 808, dispersing the second functional group throughout the adhesive. The second functional group may comprise functionalities such as esters, dithianes, N-heterocyclic carbene adducts, cyclobutanes, and other strained molecules, for example.

In another embodiment, a catalyst may be coupled to one or more surface(s) of one or more microelectronic element(s) 804 by physisorption, which is the physical functionalization of a surface. In one embodiment, physical functionalization may comprise coating a surface with a solution including a catalyst. A catalyst may not be chemically bonded to the surface of one or more microelectronic element(s) if coupled by physisorption.

Catalyst materials suitable for physisorption may have properties including amorphous film forming qualities and very high reactivity with an underfill adhesive such as epoxy resins, for example. In one embodiment, a catalyst may comprise one of the following functional groups: substituted imidazoles, N-heterocyclic carbene adducts, carboxylic acids, amines, and highly Lewis acidic compounds including trifluoroborate adducts.

Manufacturing equipment may receive one or more microelectronic element(s) 802 to apply an adhesive to one or more surface(s) of one or more microelectronic element(s) 806. In one embodiment, manufacturing equipment may receive a die and a substrate coupled together with one or more catalyst-functionalized surface(s). In another embodiment, manufacturing equipment may receive a BGA package and circuit board coupled together with one or more catalyst-functionalized surface(s).

Applying an adhesive to one or more surface(s) of one or more microelectronic element(s) 806 may comprise applying an adhesive so that it may flow between a substrate and die or between a BGA package and circuit board, for example, by capillary action. Applying an adhesive 806 may substantially fill the space between one or more microelectronic element(s) such as between a substrate and die, for example.

In an embodiment, applying an adhesive 806 comprises applying an adhesive comprising epoxies. In alternative embodiments, applying an adhesive 806 comprises applying an adhesive comprising alternative chemistries such as acrylates, vinyl ethers, olefin metathesis, urethanes, and others.

In one embodiment, applying an adhesive 806 expressly provides for applying an adhesive without a hardener ingredient and without a catalyst ingredient. Formulations of adhesive may not contain any hardener or catalyst ingredient at all. For example, adhesive formulations may comprise epoxy resins, filler, wetting agents, toughening agents, coupling agents and other components known to those skilled in the art, with no catalyst or hardener at all. Such formulation without catalysts or hardeners in the adhesive itself may provide several benefits including much longer potlife and ability to store at or near room temperature.

Adhesive may begin to polymerize or cure upon contact with a catalyst-functionalized is surface 808. The cure or polymerization of adhesive may be rapid and may occur at low temperature. In one embodiment, adhesive curing or polymerization occurs at or near room temperature. In one embodiment, an adhesive may not require the addition of thermal energy to create a rigid or solid form adhesive.

The use of catalyst-functionalized surfaces in a package assembly curing scheme may provide the benefit of allowing room temperature storage, increasing potlife, and allowing rapid cure at low temperature of an underfill adhesive. Adhesive may not contain catalyst or hardener ingredients and, thus, may not begin to polymerize or cure until the formulation is brought into contact with the catalyst-functionalized surface. Adhesive may have very low reactivity at ambient temperature allowing for long potlife and room temperature storage, but may have high reactivity once brought into contact with catalyst-functionalized surfaces allowing rapid cure and/or cure at low temperature.

Various operations may be described as multiple discrete operations in turn, in a manner that is most helpful in understanding the invention. However, the order of description should not be construed as to imply that these operations are necessarily order dependent. In particular, these operations need not be performed in the order of presentation. Operations described may be performed in a different order than the described embodiment. Various additional operations may be performed and/or described operations may be omitted in additional embodiments.

Figure 9:
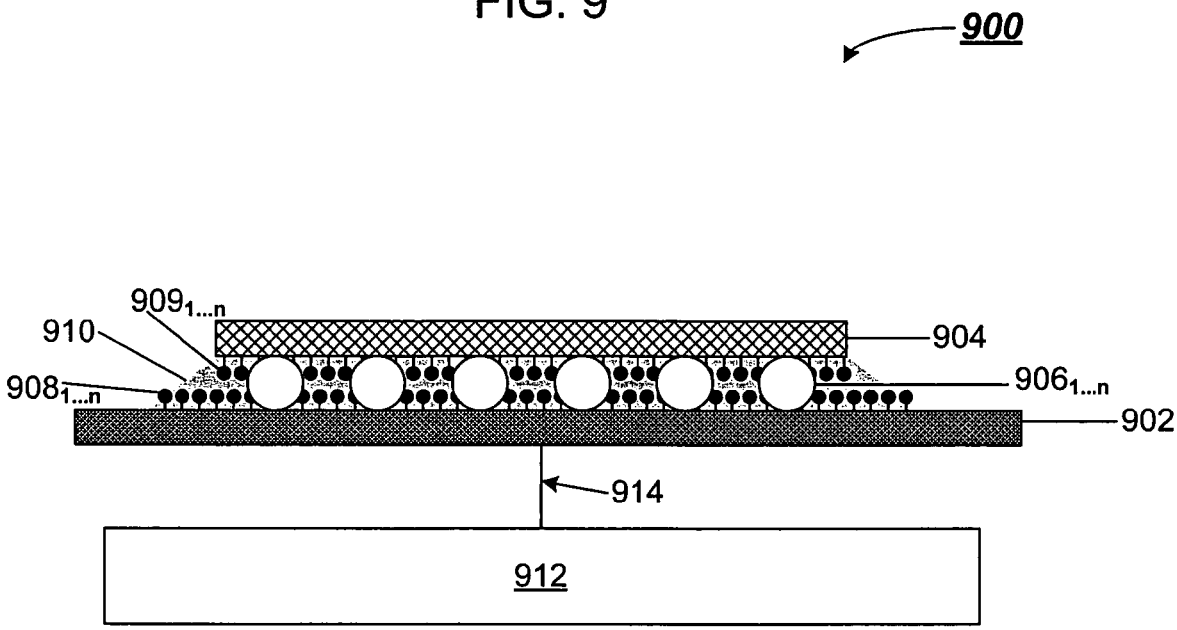
FIG. 9 depicts a system comprising, in part, a die and substrate with catalyst-functionalized surfaces, according to but one example embodiment.

FIG. 9 depicts a system 900 comprising, in part, a die 904 and substrate 902 with catalyst-functionalized surfaces, according to but one embodiment. System 900 features a substrate 902, die 904, array of solder balls $\mathbf{906}_{1 \ldots n}$, catalyst $\mathbf{908}_{1 \ldots n}$ coupled to substrate 902, catalyst $\mathbf{909}_{1 \ldots n}$ coupled to die 904 (where n represents a variable number of repeating structures), adhesive 910, and microelectronic device 912 electrically coupled 914 to die 904 through substrate 902, each system component coupled as shown.

According to one embodiment, microelectronic device 912 is a memory device. In another embodiment, other microelectronic element(s) such as a BGA package and printed circuit board are interchangeable with die 904 and substrate 902.

In another embodiment, microelectronic device 912 is another die. Microelectronic device 912 may be directly electrically coupled to a die 904 without going through substrate 902.

All other embodiments previously described in association with FIGS. 1-8 may also apply to system 900.

The above description of illustrated embodiments of the invention, including what is described in the Abstract, is not intended to be exhaustive or to limit the invention to the precise forms disclosed. While specific embodiments of, and examples for, the invention are described herein for illustrative purposes, various equivalent modifications are possible within the scope of the invention, as those skilled in the relevant art will recognize.

These modifications can be made to the invention in light of the above detailed description. The terms used in the following claims should not be construed to limit the invention to the specific embodiments disclosed in the specification and the claims. Rather, the scope of the invention is to be determined entirely by the following claims, which are to be construed in accordance with established doctrines of claim interpretation.

What is claimed is:

1. An microelectronic device comprising:

one or more microelectronic element(s); and a catalyst coupled to one or more surface(s) of the one or more microelectronic element(s) to promote polymerization of an adhesive brought in contact with the catalyst, wherein the catalyst is coupled to one or more surface(s) of the one or more microelectronic element(s) by chemisorption.

2. An microelectronic device according to claim 1, wherein the one or more microelectronic element(s) are selected from the group consisting of a substrate, die, BGA package, printed circuit board, C4 array, and wafer.

3. An microelectronic device according to claim 1, wherein the catalyst comprises a first and a second functional group, the first functional group to couple with the one or more surface(s) and the second functional group to catalyze the polymerization of an adhesive brought in contact with the catalyst, the first functional group selected from the group consisting of trialkoxysilane, chlorosilanes, acid chlorides, amines, azides, alkynes, and amines and the second functional group selected from the group consisting of substituted imidazoles, N-heterocyclic carbenes, carboxylic acids, amines, Lewis acid compounds, and trifluoroborate adducts.

4. An microelectronic device according to claim 1, wherein the catalyst comprises a first and a second functional group coupled together, wherein the first and second functional groups separate from each other upon reaction of the catalyst with an adhesive, the first functional group to couple with the one or more surface(s) and the second functional group to catalyze the polymerization of an adhesive brought in contact with the catalyst.

5. An microelectronic device according to claim 1, wherein the catalyst comprises a first and a second functional group, and wherein the second functional group is selected from the group consisting of esters, dithianes, N-heterocyclic carbene adducts, and cyclobutanes.

6. An microelectronic device according to claim 1, further comprising:

an adhesive coupled to the one or more surface(s) of the one or more microelectronic element(s).

7. An microelectronic device according to claim 6, wherein the adhesive does not comprise a hardener ingredient and does not comprise a catalyst ingredient.

8. An microelectronic device according to claim 6, wherein the adhesive comprises an ingredient selected from the group consisting of epoxy resins, acrylates, vinyl ethers, olefin metathesis, and urethanes.

9. A method comprising:

receiving one or more microelectronic element(s); and coupling a catalyst to one or more surface(s) of the one or more microelectronic element(s) to promote polymerization of an adhesive brought in contact with the catalyst, wherein coupling a catalyst to one or more surface(s) comprises chemisorption.

10. A method according to claim 9 wherein coupling a catalyst to one or more surface(s) comprises:

applying a catalyst to one or more surface(s) of the one or more microelectronic element(s); and applying heat to couple the catalyst to one or more surface(s) of the one or more microelectronic element(s).

11. A method according to claim 10 wherein applying a catalyst to one or more surface(s) of the one or more microelectronic element(s) comprises a technique selected from the group consisting of dip coating, screen printing, spraying, and spin coating.

12. A method according to claim 9 wherein receiving one or more microelectronic element(s) comprises receiving an element selected from the group consisting of a substrate, die, BGA package, printed circuit board, C4 array, and wafer.

13. A method according to claim 9 wherein the catalyst comprises a first and a second functional group, the first functional group to couple with the one or more surface(s) and the second functional group to catalyze the polymerization of an adhesive brought in contact with the catalyst, the first functional group selected from the group consisting of trialkoxysilane, chlorosilanes, acid chlorides, amines, azides, alkynes, and amines and the second functional group selected from the group consisting of substituted imidazoles, N-heterocyclic carbenes, carboxylic acids, amines, Lewis acid compounds, and trifluoroborate adducts.

14. A method according to claim 9, wherein the catalyst comprises a first and a second functional group coupled together, wherein the first and second functional groups are separated from each other upon reaction of the catalyst with an adhesive, the first functional group to couple with the one or more surface(s) and the second functional group to catalyze the polymerization of an adhesive brought in contact with the catalyst.

15. A method according to claim 9, wherein the catalyst comprises a first and a second functional group, and wherein the second functional group is selected from the group consisting of esters, dithianes, N-heterocyclic carbene adducts, and cyclobutanes.

16. A method according to claim 9, further comprising:

Applying an adhesive to the one or more surface(s) of the one or more microelectronic element(s).

17. A method according to claim 16 wherein applying an adhesive comprises applying an adhesive that does not comprise a hardener ingredient and does not comprise a catalyst ingredient.

18. A method according to claim 16 further comprising:

catalyzing polymerization of the adhesive upon application of the adhesive to the functionalized surface(s).

* * * * *

UNITED STATES PATENT AND TRADEMARK OFFICE

CERTIFICATE OF CORRECTION

PATENT NO. : 7,579,046 B2
APPLICATION NO. : 11/322402
DATED : August 25, 2009
INVENTOR(S) : Lehman, Jr. et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 542 days.

Signed and Sealed this

Fourteenth Day of September, 2010

David J. Kappos

David J. Kappos
*Director of the United States Patent and Trademark Office*